US006508175B1

(12) United States Patent
Avetisian

(10) Patent No.: US 6,508,175 B1
(45) Date of Patent: Jan. 21, 2003

(54) PYROTECHNIC INITIATOR FOR USE IN HIGH PRESSURE ENVIRONMENTS

(75) Inventor: Vahan Avetisian, Newbury Park, CA (US)

(73) Assignee: Special Devices, Inc., Moorpark, CA (US)

( * ) Notice: Subject to any disclaimer, the term of this patent is extended or adjusted under 35 U.S.C. 154(b) by 37 days.

(21) Appl. No.: 09/703,063

(22) Filed: Oct. 31, 2000

(51) Int. Cl.[7] ..... F42C 19/12
(52) U.S. Cl. ..... 102/202.14
(58) Field of Search ..... 102/202.14, 202.5, 102/202.7

(56) References Cited

U.S. PATENT DOCUMENTS 5,602,359 A * 2/1997 Hambro et al. ..... 102/202.5
5,621,183 A * 4/1997 Bailey ..... 102/202.14
5,648,634 A * 7/1997 Avory et al. ..... 102/202.14
5,942,717 A * 8/1999 Pathe et al. ..... 102/202.2
5,988,069 A * 11/1999 Bailey ..... 102/202.14
6,009,809 A * 1/2000 Whang ..... 102/202.7
6,073,963 A * 6/2000 Hamilton et al. ..... 102/202.2
6,213,800 B1 * 4/2001 Mramor ..... 439/188
6,257,910 B1 * 7/2001 Mramor ..... 439/188
6,289,813 B1 * 9/2001 Duguet et al. ..... 102/202.5
6,341,562 B1 * 1/2002 Brisighella ..... 102/202.14

* cited by examiner

*Primary Examiner*—Michael J. Carone
*Assistant Examiner*—Denise J Buckley
(74) *Attorney, Agent, or Firm*—Law Offices of Thomas J. Brindisi

(57) ABSTRACT

A pyrotechnic initiator adapted for insertion into a sealed gas unit includes an igniter over which a nonconductive body is molded. The nonconductive body resists the pressure inside a sealed gas unit and protects the igniter from that pressure. The body provides substantially all of the structural support for the igniter. The body is molded onto a retainer, onto which a cup is attached to form a pressure seal and a hermetic seal against the gases within the sealed gas unit. Because the body carries substantially all of the structural loads exerted by the gas within the sealed gas unit, the cup can be made substantially thinner than previously possible.

8 Claims, 1 Drawing Sheet

PYROTECHNIC INITIATOR FOR USE IN HIGH PRESSURE ENVIRONMENTS

BACKGROUND OF THE INVENTION

The field of this invention generally relates to pyrotechnic initiators, and more particularly to a pyrotechnic initiator adapted for use in a high-pressure environment.

Pyrotechnic initiators have many uses in industrial and consumer applications. For example, an initiator may be used as a component in a motor vehicle airbag inflator device. One known inflator device includes a pressure chamber having gas sealed within at high pressure, typically an inert gas at a pressure of 3000–4000 psi. The gas and heat released from initiator combustion causes a pressure spike within the sealed chamber, which is used to inflate the airbag. The pressure chamber and components exposed to the pressure within are constructed from materials and components that can contain and withstand that pressure over a period of years. Components of the inflator device that cannot withstand such high pressure are isolated from the pressure chamber by burst discs or other structural members. Known pyrotechnic initiators are not designed to withstand the high-pressure within the sealed gas unit, and must be isolated from it. Isolating components from the pressure chamber generally requires complex machine work and high strength materials, both of which are expensive. Typically, to isolate a pyrotechnic initiator from the pressure chamber, a thick metal cup surrounds a portion of the initiator and bears the loads generated by the high pressure within the pressure chamber. Because the pyrotechnic charge in the initiator must rupture or burst that thick cup in order to perform useful work, a more powerful pyrotechnic charge must be used than would be required in the absence of the cup. Although such a cup may be stamped from a thick metal sheet, a stamping operation utilizing thick metal is difficult and expensive.

SUMMARY OF THE PREFERRED EMBODIMENTS

A pyrotechnic initiator adapted for insertion into a sealed gas unit includes an igniter, over which a nonconductive body is molded. The nonconductive body resists the pressure inside a sealed gas unit and protects the igniter from that pressure. The body is molded onto a retainer, onto which a cup is attached to form a pressure seal and a hermetic seal against the gases within the sealed gas unit. The body is overmolded to carry substantially all of the structural loads exerted by the gas within the sealed gas unit on the initiator, allowing the cup to be made substantially thinner than previously possible.

DETAILED DESCRIPTION OF THE PREFERRED EMBODIMENTS

Figure 1:
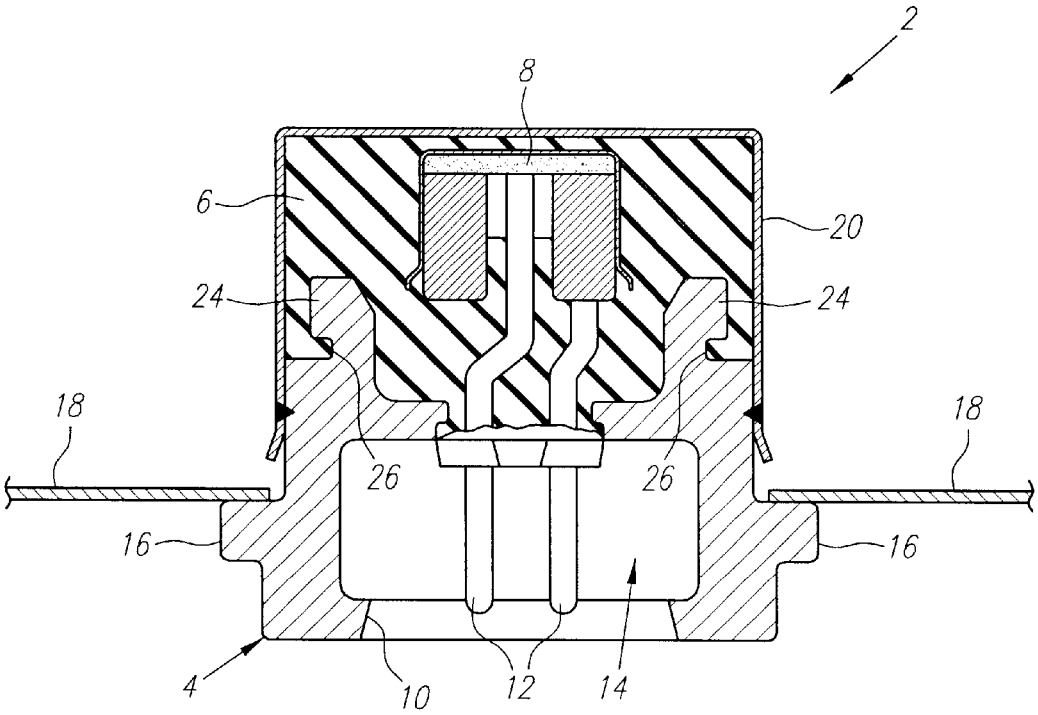
FIG. 1 is a side cross-section view of a pyrotechnic initiator.

Referring to FIG. 1, a pyrotechnic initiator 2 is shown. The initiator 2 includes a retainer 4 and a nonconductive body 6. The retainer 4 is preferably metallic, and may be stamped, machined or otherwise formed. Advantageously, the retainer 4 is made of steel. However, it is within the scope of the preferred embodiment to provide a retainer 4 that is made of a different metallic material, or a nonmetallic material, as long as that material possesses adequate strength and durability for use in the initiator 2. The retainer 4 includes a connector 10 at one end which is adapted to connect to a mating vehicle connector (not shown) provided at the place of use of the pyrotechnic initiator 2, such as a steering wheel or motor vehicle dashboard. Preferably, the retainer 4 is shaped to form the connector 10 at one end as an integral component of the retainer 4. However, the connector 10 may be a separate component that is attached to the retainer 4.

The body 6 is formed into the retainer 4, preferably by an injection molding process, and is composed of a nonconductive material, preferably nylon. However, the body 6 may be composed of other nonconductive materials, such as plastic, that are capable of being molded or formed into a desired shape while having adequate strength and durability and adequate suitability for pyrotechnic applications. In a preferred embodiment, the body 6 is attached to the retainer 4 both through direct adhesion between the body 6 and the upper surfaces of the retainer 4 and through mechanical interconnection between the body 6 and the retainer 4. The body 6 provides structural support for a cup 20 that is described in greater detail below. By supporting the cup 20, the body 6 relieves the cup 20 of substantially all structural loads, thereby substantially eliminating structural loading as a design constraint upon the cup 20.

Preferably, the retainer 4 includes a molding feature 24 which extends from the connector 10 in a substantially axial direction into the body 6. The molding feature 24 is preferably continuous and annular in a plane substantially perpendicular to the axial centerline of the connector 10, such that it forms a substantially circular structure opening toward the igniter 8. However, it is within the scope of the preferred embodiment to provide a plurality of discrete molding features 24, or to provide a continuous molding feature 24 having a different shape or orientation, in order to secure the body 6 to the retainer 4. Preferably, the molding feature 24 includes a notch 26 around its outer circumference. The notch 26 may alternately be placed around the inner circumference of the molding feature 24. A portion of the body 6 is formed in the notch 26. The notch 26 assists in securing the body 6 to the retainer 4, in part because a portion of the body 6 extends into the notch 26 and is retained there, resisting axial movement of the body 6, and in part because the molding feature 24 increases the surface area of the retainer 4 in contact with the body 6. The molding feature or features 24 may include structures in addition to or other than the notch 26 which enhance the strength of the attachment between the retainer 4 and the body 6.

In a preferred embodiment, an igniter 8 is formed into the body 6. The igniter 8 includes a pyrotechnic charge which combusts when an electric charge is passed through it. The construction and use of such an igniter 8 is known to those skilled in the art. Preferably, two electrical leads 12 extend from the igniter 8 through the body 6 into a hollow interior 14 within the connector 10. Because the retainer 4 is preferably metallic, and is therefore conductive, the initiator 2 preferably is constructed such that the electrical leads 12 do not come in contact with the retainer 4. Because the body 6 is nonconductive, the body 6 prevents stray current from entering the electrical leads 12 through an unexpected path, thereby preventing accidental ignition of the igniter 8. Alternately, if the retainer 4 is not conductive, the electrical leads 12 may contact the retainer 4 without ill effect.

Figure 2:
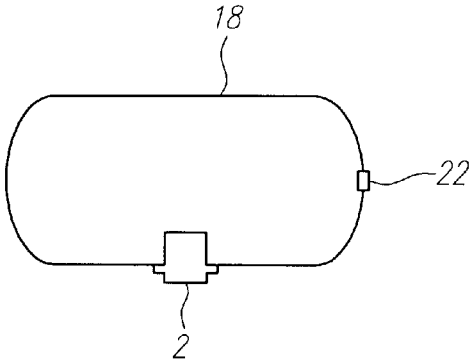
FIG. 2 is a side cross-section schematic view of a pyrotechnic initiator installed in a sealed gas unit.

The initiator 2 is adapted for insertion into a sealed gas unit 18, as further shown in FIG. 2. Preferably, the sealed gas unit 18 is a pressure vessel filled with inert gas at a pressure of 3000–4000 psi; however, it is within the scope of the preferred embodiment that the pressure within the sealed gas unit 18 is outside that range, as may be desirable in some applications. It is also within the scope of the preferred embodiment that the gas within the sealed gas unit 18 is not inert. The gas need not be a single gas, and may be a mixture of different gases if desired.

The body 6 is formed around the igniter 8 and structurally interconnects the igniter 8 and the retainer 4. The body 6 is overmolded around the igniter 8, meaning that the body 6 is constructed to be thick enough in all three dimensions around the igniter 8 such that the igniter 8 experiences substantially no forces resulting from the pressure within the sealed gas unit 18. That is, the igniter 8 is shielded from the high pressure conditions within the sealed gas unit 18 by the mass and strength of the body 6. The dimensions of the body 6 depend on the pressure of the gas within the sealed gas unit 18, the size and explosive power of the igniter 8, the size of the initiator 2, and the characteristics of the material from which the body 6 is formed. The size of the body 6 and the explosive force of the igniter 8 are also chosen such that the explosive force of the igniter 8 is adequate to fracture, rupture, or otherwise structurally disrupt the body 6 when the igniter 8 is fired.

A cup 20 is placed over th e body 6 and attached to the retainer 4 to provide a hermetic seal, which prevents moisture, gases, and other contaminants from entering, and a pressure seal. If the body 6 is injection molded, it may shrink during the molding process. Thus, a reliable seal does not exist between the body 6 alone and the retainer 4. The cup 20 contacts and covers the entire outer surface of the body 6, thereby protecting the body 6 from direct contact with the high-pressure gas within the sealed gas unit 18. The cup 20 is attached to the retainer 6 in such as way as to form a reliable hermetic seal and pressure seal with the retainer 4 that does not degrade substantially with age, and that protects the igniter 8 and the other components within. Preferably, the cup 20 is metallic, and is welded onto the retainer 4. In a preferred embodiment, the cup 20 is steel, but the cup 20 may be any other metal capable of durable attachment to the retainer 4 and capable of forming a hermetic seal with the retainer 4. It is within the scope of the preferred embodiment to provide a cup 20 that is nonmetallic, as long as that cup 20 is capable of forming a durable hermetic seal with the retainer 4 when properly attached to the retainer 4 with adhesive or with another effective method or mechanism.

The body 6 provides structural support for the cup 20, relieving the cup 20 of substantially all structural loads. Although the cup 20 experiences force resulting from the pressure within the sealed gas unit 18, it does not substantially resist or transmit that force. Instead, the body 6 resists and transmits the structural loads resulting from that force. The cup 20 is supported by the body 6; the cup 20 does not support the body 6. The body 6, instead of the cup 20, provides substantially all of the structural support for the igniter 8 and protects the igniter 8 from the forces resulting from the pressure of the gas within the sealed gas unit 18. In contrast to the function of the body 6, the cup 20 provides a seal with the retainer 4 to protect the body 6 and the igniter 8 against the undesired entry of gas and contaminants from within the sealed gas unit 18. The cup 20 is therefore advantageously constructed to be as thin as possible, while retaining the ability to form a durable hermetic seal and pressure seal with the retainer 4. Preferably, the cup 20 is stamped or otherwise formed in a way that does not require it to be machined, in order to reduce manufacturing time and cost.

The initiator 2 is inserted into a port in the sealed gas unit 18. In a preferred embodiment, the retainer 4 includes a flange 16 that is shaped and sized to overlap the edges of the port in the sealed gas unit 18. Preferably, the port is substantially circular and the flange 16 is substantially annular, with an outer radius larger than the radius of the port. However, the port and the corresponding flange 16 may be shaped differently, if desired. The flange 16 prevents the initiator 2 from falling into the sealed gas unit 18 during assembly, and provides a surface area on the initiator 2 for contact with the outer surface of the sealed gas unit 18 to facilitate connection and sealing between the initiator 2 and the sealed gas unit 18. The flange 16 is preferably welded to the sealed gas unit 18, because of the strength and the leak resistance that welding provides. However, the flange 16 may be attached to the sealed gas unit 18 with adhesive or by other means that provide a strong and durable connection to the initiator 2 and which do not allow leakage from the sealed gas unit 18 through the connection between the sealed gas unit 18 and the initiator 2.

To fire the initiator 2, an electrical current is transmitted to the igniter 8 through the electrical leads 12. The igniter 8 then combusts rapidly, generating hot gas and combustion byproducts and resulting in a force sufficient to fracture, rupture, shatter or otherwise destroy the structure integrity of both the body 6 and the cup 20. The products of pyrotechnic ignition then escape the initiator 2 into the sealed gas unit 18. The rapid combustion of the igniter 8 has several effects. First, it increases the pressure within the sealed gas unit 18 as the pyrotechnic fuel in the initiator 2 combines with oxidizer to create gaseous reaction products that are driven into the sealed gas unit 18. Second, the rapid combustion creates a shock wave within the sealed gas unit 18, creating local pressure spikes and forces that travel around the sealed gas unit 18. Third, the combustion of the igniter 8 produces heat, which escapes into the constant-volume sealed gas unit 18 and has the effect of driving pressure up in the sealed gas unit 18, as an expected result of the ideal gas law. The net effect of combustion of the igniter 8 is to rapidly increase the pressure within the sealed gas unit 18. A burst disk 22 is located on the sealed gas unit 18, and is constructed to rupture when a predetermined pressure is reached within the sealed gas unit 18. The construction and use of a burst disk 22 in a pyrotechnic application is known to those skilled in the art. The position of the burst disk 22 relative to the initiator 2 on the sealed gas unit 18 is not important to the operation of the sealed gas unit. When the pressure within the sealed gas unit 18 reaches a level equivalent to the pressure at which the burst disk 22 is designed to rupture, the burst disk 22 ruptures, and hot gas at high pressure escapes the sealed gas unit 18 through the ruptured burst disk 22. Alternately, the burst disk 22 may be designed to rupture upon encountering the shock wave produced by the combustion of the igniter 8. The sealed gas unit 18 is positioned next to a device which utilizes the hot gas escaping from the sealed gas unit 18 through the ruptured burst disk 22 to perform useful work, such as but not limited to inflating an airbag adjacent to the burst disk 22.

A preferred pyrotechnic system and many of its attendant advantages has thus been disclosed. It will be apparent, however, that various changes may be made in the form, construction and arrangement of the parts without departing from the spirit and scope of the invention, the form hereinbefore described being merely a preferred or exemplary embodiment thereof. Therefore, the invention is not to be restricted or limited except in accordance with the following claims and their legal equivalents.

What is claimed is:

1. A pyrotechnic initiator for insertion into a sealed gas unit containing pressurized gas, comprising:

a retainer including a connector having a hollow interior;

an igniter;

electrical leads extending from said igniter into said hollow interior of said connector;

a nonconductive body overmolded around said igniter and formed into said retainer; and a metal cup engaging and covering the outer surface of said body for structural support and attached to said retainer to form a substantially hermetic seal.

2. The initiator of claim 1, wherein said retainer is metallic and said cup is welded to said retainer.

3. The initiator of claim 1, further comprising a flange extending outward from said retainer.

4. The initiator of claim 3 wherein said flange is substantially annular.

5. The initiator of claim 1, further comprising a molding feature extending from said retainer into said body.

6. The initiator of claim 5, wherein said molding feature is substantially annular.

7. The initiator of claim 5, further comprising a notch in said molding feature.

8. A pyrotechnic initiator for insertion into a sealed gas unit containing gas at pressure, comprising:

a metal retainer including a connector having a hollow interior;

a flange extending outward from said retainer;

an igniter;

electrical leads extending from said igniter into said hollow interior of said connector;

a nonconductive body overmolded around said igniter and formed into said retainer such that said igniter experiences substantially no forces resulting from the pressure within the sealed gas unit;

a notched annular molding feature extending from said retainer into said body; and a metal cup covering the outer surface of said body and welded to said retainer to form a substantially hermetic seal, wherein said cup carries substantially no structural loads.

* * * * *